US006524083B2

(12) United States Patent
Deai et al.

(10) Patent No.: US 6,524,083 B2
(45) Date of Patent: Feb. 25, 2003

(54) MAGNETIC COUPLING PUMP

(75) Inventors: Junji Deai, Obu (JP); Hirohisa Itou, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 104 days.

(21) Appl. No.: 09/820,793

(22) Filed: Mar. 30, 2001

(65) Prior Publication Data

US 2001/0033800 A1 Oct. 25, 2001

(30) Foreign Application Priority Data

Apr. 25, 2000 (JP) ..... 2000-123877

(51) Int. Cl.[7] ..... F04B 17/00
(52) U.S. Cl. ..... 417/370; 417/423.7; 417/423.14
(58) Field of Search ..... 417/423.7, 423.14, 417/370

(56) References Cited

U.S. PATENT DOCUMENTS 5,217,353 A * 6/1993 De Filippis ..... 417/354
5,738,503 A * 4/1998 Schmidt-Marloh et al. ..... 417/423.14
5,769,069 A * 6/1998 Caffell ..... 126/634
6,036,456 A * 3/2000 Peters et al. ..... 417/423.14
6,065,946 A * 5/2000 Lathrop ..... 310/43
6,208,048 B1 * 3/2001 Deynet ..... 310/71
6,280,157 B1 * 8/2001 Cooper ..... 417/423.7

FOREIGN PATENT DOCUMENTS

JP 10-311290 11/1998

* cited by examiner

*Primary Examiner*—Charles G. Freay
*Assistant Examiner*—W H. Rodriguez
(74) *Attorney, Agent, or Firm*—Rader, Fishman & Grauer PLLC

(57) ABSTRACT

A partition partitions off a motor chamber and a pump chamber, through which a cooling water flows, a substantially cylindrical-cup shaped rotor is arranged in the pump chamber, a circuit board is disposed in the motor chamber to be in parallel to an annular-shaped end surface of the rotor, a magnetism detecting element is mounted on that portion of the circuit board, which faces a magnet portion of the rotor, and exothermic electronic parts are mounted on the remaining portion of the circuit board. The magnetism detecting element and the exothermic electronic parts, respectively, are arranged in opposite positions in a substantially annular-shaped area of the circuit board, which faces the annular-shaped end surface of the rotor, and a thickness of an annular-shaped wall portion of the partition facing the annular-shaped end surface of the rotor is made thin in a portion adjacent to the exothermic electronic parts on condition that an annular-shaped surface of the annular-shaped wall portion on a side of the annular-shaped end surface of the rotor is a non-inclined flat surface.

4 Claims, 3 Drawing Sheets

MAGNETIC COUPLING PUMP

BACKGROUND OF THE INVENTION (1) Field of the Invention

The invention relates to a magnetic coupling pump, and more particularly, to a magnetic coupling pump, used as a water pump, to contemplate enhancement of cooling efficiency for exothermic electronic parts mounted on a circuit board as well as improvement of detection accuracy of a magnetism detecting element mounted on the circuit board.

(2) Description of the Prior Art

As is well-known, a magnetic coupling pump used as a water pump is constructed such that a partition partitions off a motor chamber and a pump chamber, through which a cooling water flows, a rotor is disposed in the pump chamber, and a stator (motor) is disposed in the motor chamber.

As an example of conventional magnetic coupling pumps, there has been known a magnetic coupling pump, as disclosed in FIG. 2 of Japanese Patent Laid-Open No. 311290/1998, constructed such that a circuit board is disposed in a motor chamber to be in parallel to an end surface of a rotor, exothermic electronic parts, such as power transistors or the like, for driving a motor, are mounted on a remaining portion of the circuit board facing the end surface of the rotor, and the exothermic electronic parts are cooled by a cooling water through a partition.

Also, among conventional magnetic coupling pumps, there has been known a magnetic coupling pump constructed such that a Hall element as a magnetism detecting element for detecting a rotating angle position of a rotor is mounted on that portion of a circuit board, which faces a magnet portion of the rotor, in order to control timing of energization of a motor, in other words, to control the switching action of power transistors or the like.

Further, there has been known a magnetic coupling pump of that type, in which both the above exothermic electronic parts and the above magnetism detecting element are mounted on a circuit board.

However, with a magnetic coupling pump of the above-mentioned type, in which both the above exothermic electronic parts and the above magnetism detecting element are mounted on a circuit board, the exothermic electronic parts and the magnetism detecting element are arranged comparatively close to each other, so that the magnetism detecting element is susceptible to thermal damage from the exothermic electronic parts. Also, since the exothermic electronic parts are larger in thickness than the magnetism detecting element, an air gap between the magnetism detecting element and a partition is comparatively large, which restricts detection accuracy of the magnetism detecting element.

3. SUMMARY OF THE INVENTION

The invention has its object to solve the above-mentioned problems of the prior art and to contemplate enhancement of cooling efficiency for exothermic electronic parts as well as improvement of detection accuracy of a magnetism detecting element.

To attain the above object, a magnetic coupling pump according to the invention has a feature in comprising a partition partitioning off a motor chamber and a pump chamber, through which a cooling water flows, a substantially cylindrical-cup shaped rotor disposed in the pump chamber, a circuit board disposed in the motor chamber to be in parallel to an annular-shaped end surface of the rotor, a magnetism detecting element mounted on that portion of the circuit board, which faces a magnet portion of the rotor, and exothermic electronic parts mounted on the remaining portion of the circuit board, wherein a thickness of an annular-shaped wall portion of the partition facing the annular-shaped end surface of the rotor is made thin in a portion adjacent to the exothermic electronic parts on condition that an annular-shaped surface of the annular-shaped wall portion on a side of the annular-shaped end surface of the rotor is a non-inclined flat surface, and wherein the magnetism detecting element and the exothermic electronic parts, respectively, are arranged in opposite positions in a substantially annular-shaped area of the circuit board, which faces the annular-shaped end surface of the rotor.

In the above-mentioned manner, the annular-shaped wall portion is made thin in wall thickness, whereby the exothermic electronic parts are efficiently cooled by a cooling water, thus enabling suppressing thermal damage, which the magnetism detecting element suffers from heat generated by the exothermic electronic parts.

Also, the magnetism detecting element and the exothermic electronic parts, respectively, are arranged in substantially opposite positions in the substantially annular-shaped area of the circuit board, so that a spacing between the magnetism detecting element and the exothermic electronic parts becomes large to enable suppressing thermal damage, which the magnetism detecting element suffers from heat generated by the exothermic electronic parts.

Also, the circuit board can be made to approach the annular-shaped wall portion by a distance corresponding to reduction in wall thickness of the annular-shaped wall portion, with the result that a distance from the magnetism detecting element to an end surface of the annular-shaped wall portion on the side of the motor chamber becomes small and so a spacing between the annular-shaped end surface of the rotor and the magnetism detecting element decreases. Therefore, the magnetism detecting element is increased in detection level to be enhanced in accuracy of detection.

4. BRIEF DESCRIPTION OF THE DRAWINGS

5. DESCRIPTION OF THE PREFERRED EMBODIMENTS

Figure 1:
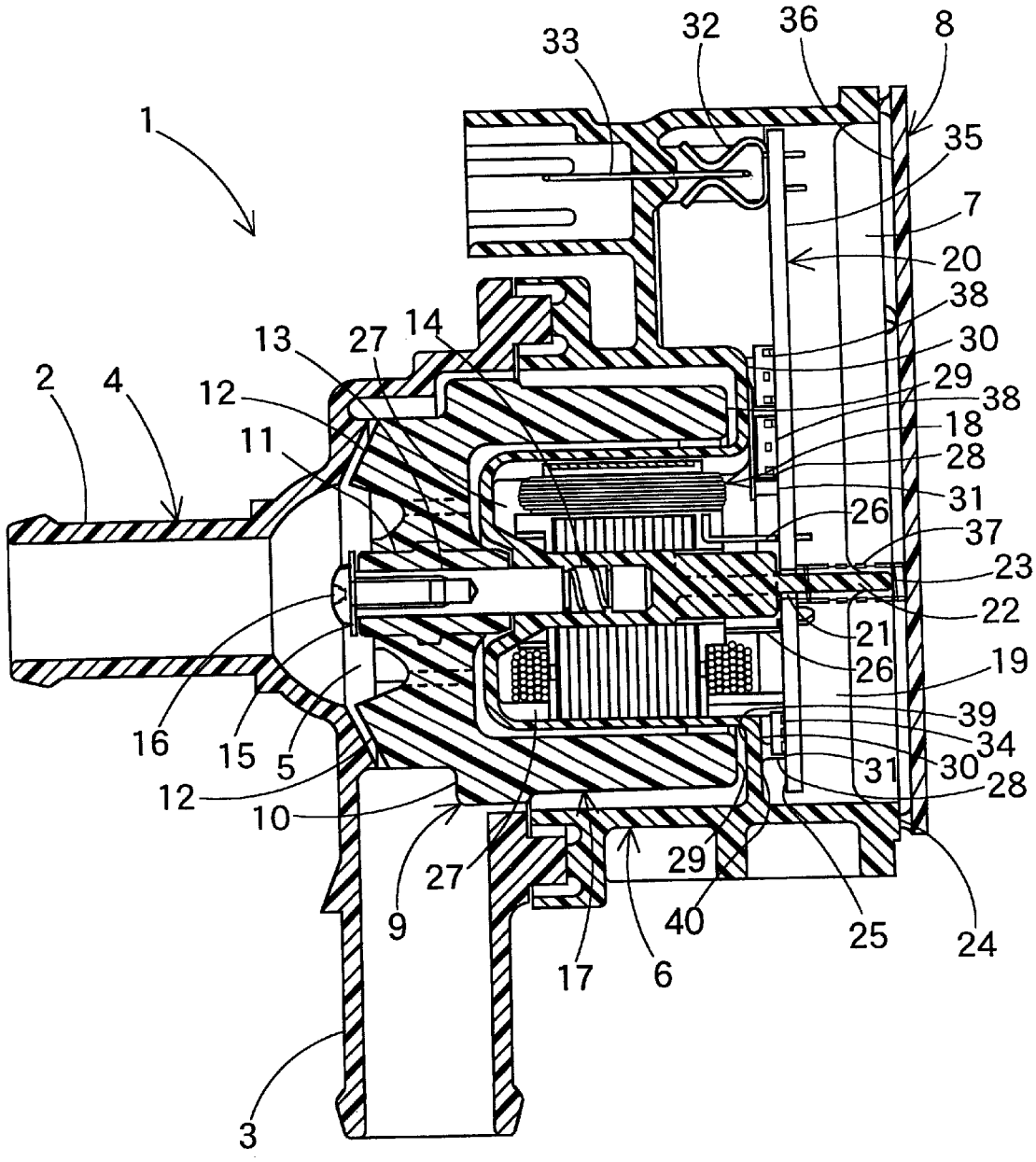
FIG. 1 is a cross sectional view showing an embodiment of a magnetic coupling pump according to the invention.

In FIG. 1, a magnetic coupling pump 1 comprises a pump chamber side housing 4 made of a synthetic resin and formed with an inflow passage 2 for a cooling water and an outflow passage 3, a body 6 made of a synthetic resin and cooperating with the pump chamber side housing 4 to define a pump chamber 5, and a motor chamber side housing 8 made of a synthetic resin and cooperating with the body 6 to define a motor chamber 7. The pump chamber side housing 4 and the body 6, and the body 6 and the motor chamber side housing 8 are fused to each other to be made integral.

A rotor 9 made of a synthetic resin is contained in the pump chamber 5.

The rotor 9 is formed to be substantially cylindrical-cup shaped, and formed centrally of a bottom 10 thereof with a cylindrical-shaped bearing 11 of PPS (polyphenylene sulfide) material, the bearing 11 being formed therearound with an impeller 12. A shaft 13 is inserted through a through hole of the bearing 11, and the rotor 9 is made rotatable about the shaft 13. The shaft 13 is partially fixed to the body 6 as an insert, and a spiral portion 14 is embedded in the body 6 to prevent the shaft 13 from rotating and getting out of the body 6. A washer 15 is mounted to a tip end of the shaft 13 by a screw 16. The washer 15 serves as a stopper for preventing the rotor 9 from floating during rotation. A cylindrical portion 17 of the rotor 9 is comprised of a plastic magnet, which contains magnetic particles and is partially magnetized in a circumferential direction. These magnet portions receive torque produced by a rotational magnetic field of a stator 18, whereby the rotor 9 is rotated.

A synthetic resin material is filled in the motor chamber 7 except a portion thereof on a side of the motor chamber side housing 8. A circuit board 20 is embedded in the filling material 19.

The circuit board 20 has a through hole 21, into which a boss 22 of the body 6 is inserted. The boss 22 is formed on an extension of the shaft 13, and a tip surface 23 thereof is substantially flush with an end surface 24 of the body 6 on a side of the motor chamber side housing 8. The stator 18 is mounted on a board surface 25 of the circuit board 20 on a side of the rotor 9 through a wiring fitting 26. The stator 18 is received in an annular-shaped recess 27 of the body 6.

The board surface 25 of the circuit board 20 on the side of the rotor 9 abuts against a plurality of support members 28. The respective support members 28 are formed integrally with the body 6, and project toward the motor chamber side housing 8 from an annular-shaped wall portion 30, which faces an annular-shaped end surface 29 of the cylindrical portion 17 of the rotor 9. The end surfaces 31 of the respective support members 28 make flush with one another.

Also, an inner terminal 32 is mounted on the board surface 25 of the circuit board 20 on the side of the rotor 9. The inner terminal 32 contacts with an exterior terminal 33, which is fixed to the body 6 for supplying electricity.

Also, a Hall element 34 as a magnetism detecting element is mounted on the board surface 25 of the circuit board 20 on the side of the rotor 9. The Hall element 34 is a sensor for detecting a rotating angular position of the rotor 9, and faces the annular-shaped end surface 29 of the cylindrical portion 17 of the rotor 9.

Figure 3:
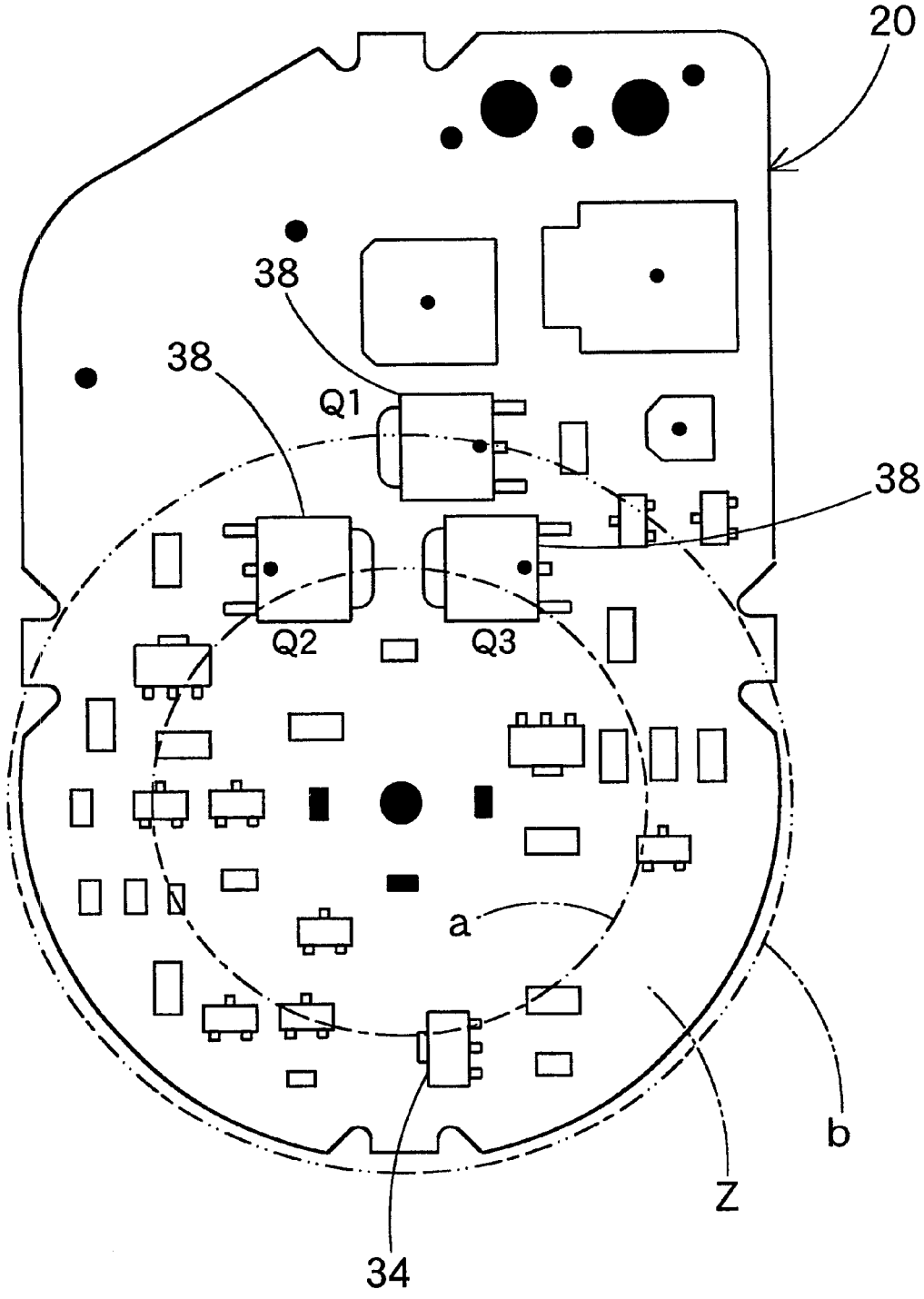
FIG. 3 is a front view showing a circuit board.

Further, a plurality of power transistors 38 as exothermic electronic parts are mounted on the board surface 25 of the circuit board 20 on the side of the rotor 9. The power transistors 38 are electronic parts for driving the stator 18. The Hall element 34 and the power transistors 38, respectively, are arranged in substantially opposite positions on a substantially annular-shaped area Z (an area surrounded by two-dot chain lines a, b in FIG. 3) of the circuit board 20, which faces the annular-shaped end surface 29 of the rotor (FIG. 1), as shown in FIG. 3.

Figure 2:
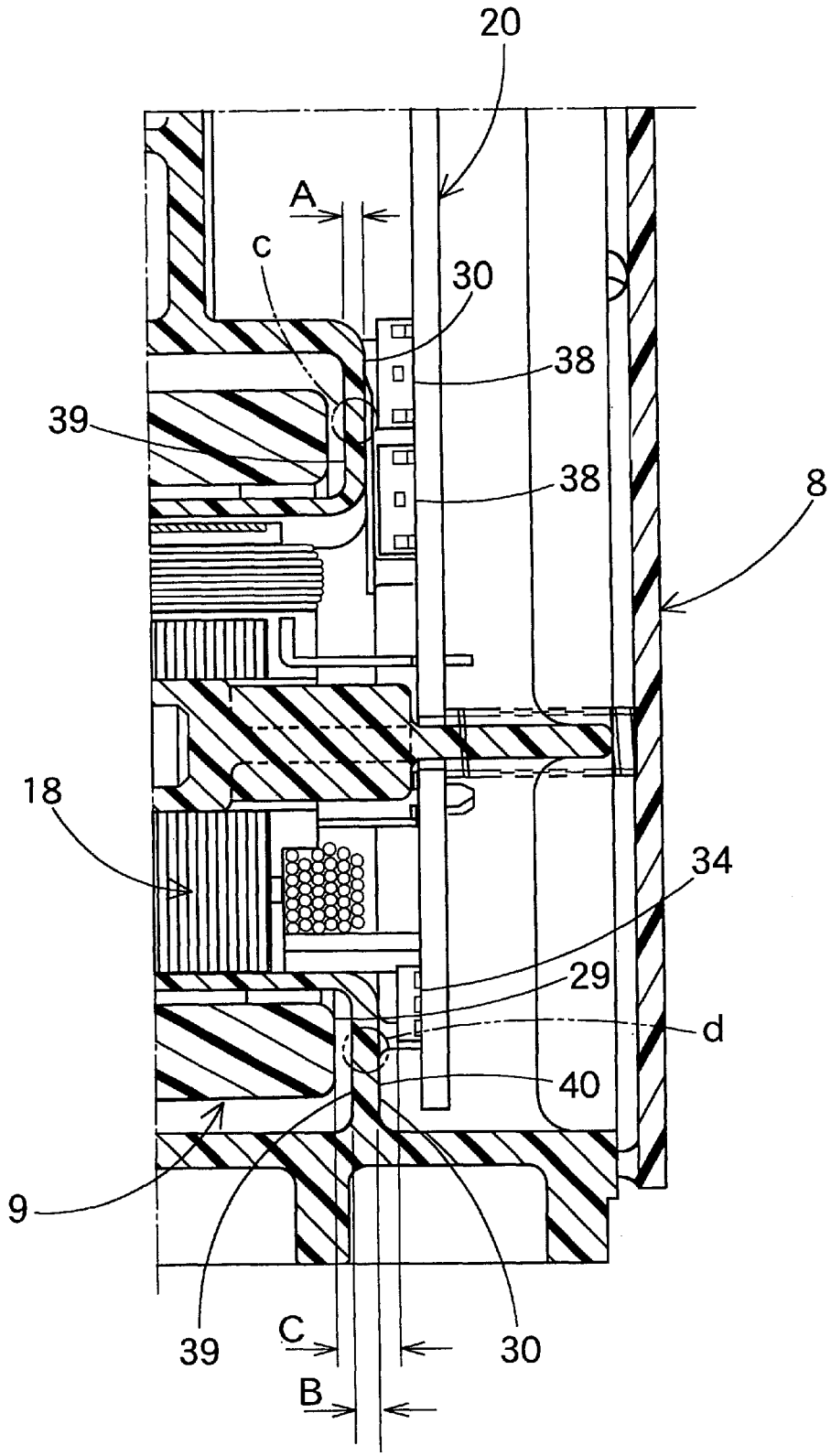
FIG. 2 is a cross sectional view showing an essential part of the pump.

An annular-shaped surface 39 of the annular-shaped wall portion 30 of the body 6 on a side of the annular-shaped end surface 29 is defined by a non-inclined flat surface. As shown in FIG. 2, a thickness of the annular-shaped wall portion 30 is made thin in a portion c adjacent to the power transistors a 38. That is, a thickness A at the portion c is less than a thickness B at a portion d opposed to the Hall element 34.

A compression spring 37 surrounding the boss 22 is arranged between the other surface 35 of the circuit board 20 and an inner surface 36 of the motor chamber side housing 8.

As described above, the embodiment has a feature in the provision of the magnetic coupling pump 1, in which a partition 6 partitions off the motor chamber 7 and the pump chamber 5, through which a cooling water flows, the substantially cylindrical-cup shaped rotor 9 is arranged in the pump chamber 5, the circuit board 20 is disposed in parallel to the annular-shaped end surface 29 of the rotor 9 in the motor chamber 7, the magnetism detecting element 34 is mounted on that portion of the circuit board 20, which faces a magnet portion of the rotor 9, the exothermic electronic parts 38 are mounted on the other portion of the circuit board 20, the magnetism detecting element 34 and the exothermic electronic parts 38, respectively, are arranged in substantially opposite positions in the substantially annular-shaped area Z of the circuit board 20, which faces the annular-shaped end surface 29 of the rotor, a thickness of the annular-shaped wall portion 30 of the partition 6 facing the annular-shaped end surface 29 of the rotor is made thin in a portion adjacent to the exothermic electronic parts 38 on condition that the annular-shaped surface 39 of the annular-shaped wall portion 30 on the side of the annular-shaped end surface 29 of the rotor is a non-inclined flat surface.

In this manner, the annular-shaped wall portion 30 is made thin in wall thickness, whereby the exothermic electronic parts 38 are efficiently cooled by a cooling water, thus enabling suppressing thermal damage, which the magnetism detecting element 34 suffers from heat generated by the exothermic electronic parts 38.

Also, the magnetism detecting element 34 and the exothermic electronic parts 38, respectively, are arranged in substantially opposite positions in the substantially annular-shaped area Z of the circuit board 20, so that a spacing between the magnetism detecting element 34 and the exothermic electronic parts 38 becomes large to enable suppressing thermal damage, which the magnetism detecting element 34 suffers from heat generated by the exothermic electronic parts 38.

Also, the circuit board 20 can be made to approach the annular-shaped wall portion 30 by a distance corresponding to reduction in wall thickness of the annular-shaped wall portion 30, with the result that a distance from the magnetism detecting element 34 to an end surface 40 of the annular-shaped wall portion 30 on the side of the motor chamber 7 becomes small and so a spacing C between the annular-shaped end surface 29 of the rotor 9 and the magnetism detecting element 34 decreases (FIG. 2). Therefore, the magnetism detecting element 34 is increased in detection level to be enhanced in accuracy of detection.

What is claimed is:

1. A magnetic coupling pump comprising:

a partition partitioning off a motor chamber and a pump chamber, through which a cooling water flows, a substantially cylindrical-cup shaped rotor disposed in the pump chamber, a circuit board disposed in the motor chamber to be in parallel to an annular-shaped and surface of the rotor, a magnetism detecting element mounted on that portion of the circuit board, which faces a magnet portion of the rotor, and exothermic electronic parts mounted on the remaining portion of the circuit board, and wherein a thickness of an annular-shaped wall portion of the partition facing an annular-shaped end surface of the rotor is thinner at a portion adjacent to the exothermic electronic parts relative to a portion adjacent to the magnetism detecting element.

2. The magnetic coupling pump according to claim 1, wherein the magnetism detecting element and the exothermic electronic parts, respectively, are arranged in opposite positions in a substantially annular-shaped area of the circuit board, which faces the annular-shaped end surface of the rotor.

3. The magnetic coupling pump according to claim 1 or 2, wherein the circuit board is disposed in close proximity to the annular-shaped wall portion yet sufficiently spaced apart therefrom such that the magnetism detecting element and the exothermic electronic parts are positioned between the circuit board and the annular-shaped wall portion.

4. The magnetic coupling pump according to claim 1 or 2, wherein an annular-shaped surface of the annular-shaped wall portion on a side of the annular-shaped end surface of the rotor is a non-inclined flat surface.

* * * * *